United States Patent [19]

Loos

[11] 4,444,232

[45] Apr. 24, 1984

[54] LOG SPLITTER

[76] Inventor: Eugene W. Loos, 408 E. Water, Pinckneyville, Ill. 62274

[21] Appl. No.: 410,266

[22] Filed: Aug. 23, 1982

[51] Int. Cl. ..... B27L 7/00

[52] U.S. Cl. ..... 144/193 A; 144/193 E

[58] Field of Search ..... 144/193 A, 193 B, 193 C, 144/193 D, 193 E, 193 F, 193 G, 193 H, 193 J, 193 K, 193 R, 366

[56] References Cited

U.S. PATENT DOCUMENTS

| | | | |
|---|---|---|---|
| 3,974,867 | 8/1976 | Butas, Jr. . | |
| 4,019,549 | 4/1977 | Williams . | |
| 4,033,390 | 7/1977 | Piontkowski . | |
| 4,157,105 | 6/1979 | Gansley . | |
| 4,222,419 | 9/1980 | Oliver . | |
| 4,275,778 | 6/1981 | Kotas . | |
| 4,303,112 | 12/1981 | Sconce | 144/193 A |
| 4,411,299 | 10/1983 | Alcott | 144/193 R |

FOREIGN PATENT DOCUMENTS

| | | | |
|---|---|---|---|
| 603135 | 6/1948 | United Kingdom | 144/193 D |

*Primary Examiner*—Leon Gilden

*Assistant Examiner*—Jorji M. Griffin

*Attorney, Agent, or Firm*—Kalish & Gilster

[57] ABSTRACT

A log splitter includes a base having a splitting device at one end and a ram movable along the rail for splitting logs by forcing their faces against the splitting device. The splitting device combines a splitting wedge and a penetrating device which extends forwardly from the splitting wedge for initial penetration of the face of the log, having a penetrating edge parallel to and in front of the cutting edge and located proximate the rail with height less than the cutting edge. The penetrating edge initially penetrates the log face at a location near the rail when the ram drives the log toward the splitting device. The penetrating device is itself of wedge-like, prow-configured character having diverging portions extending rearwardly from the penetrating edge on opposite sides of the cutting edge of the splitting edge of the splitting wedge to provide initial partial splitting of the log face near its periphery prior to its being driven against the cutting edge. A reduced depth dorsal extension of the splitting wedge allows splitting of logs having large diameters.

7 Claims, 5 Drawing Figures

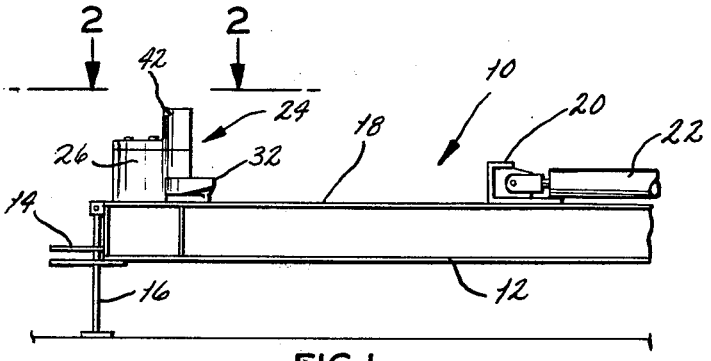
FIG. 1
FIG. 3
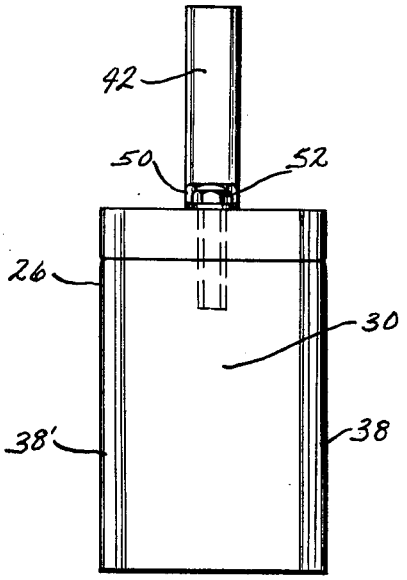
FIG. 2
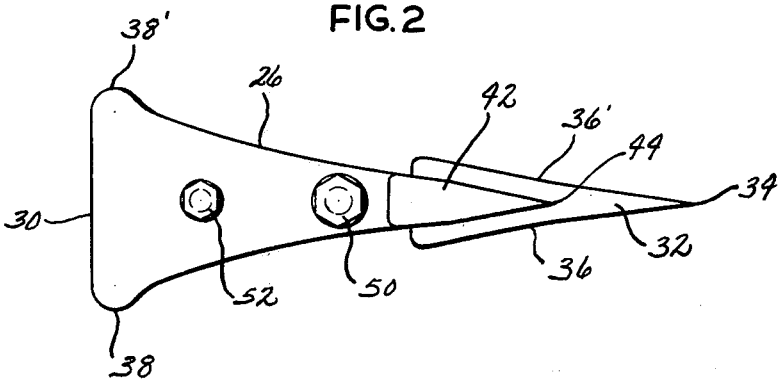
FIG. 4
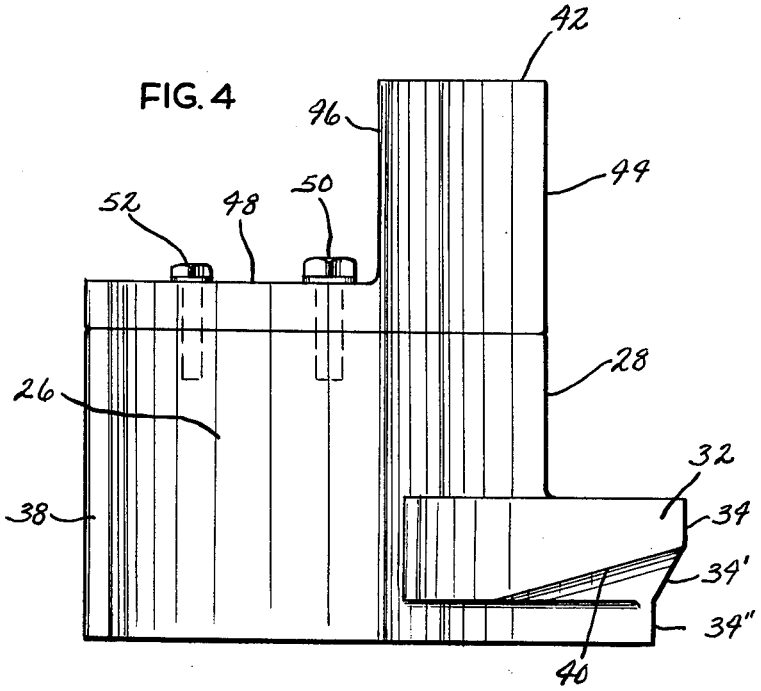
FIG. 5
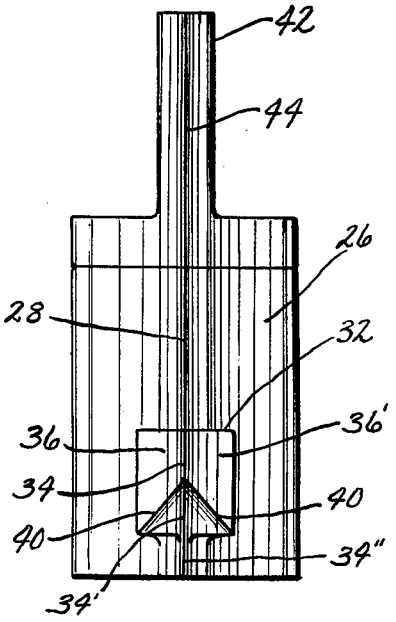

LOG SPLITTER

BACKGROUND AND SUMMARY OF THE INVENTION

This invention relates to log splitters and, more particularly, to a log splitter of the type having a ram for forcing a log against a splitting wedge.

There have been commercially many versions of portable log splitters characteristically having a trailer-like configuration for being towed by another vehicle and wherein there is typically employed a rail serving as a base upon which logs are placed for being split by forcing end faces of the logs against a splitting wedge by a ram, which may be hydraulically powered.

Heretofore, the chief limitation of such log splitters has been their inability to split large diameter logs. If the splitter is of the type having a hydraulic cylinder for driving the ram, it is not usual to employ an internal combustion engine which operates a hydraulic pump for delivering pressure to the cylinder. An increase in the diameter of logs which can be split has been obtained commonly by increasing the power of the engine but this greatly increases the cost and weight of the unit, amounting to a brute force approach to the design of the log splitter.

It is much more desirable instead to increase the capacity of the log splitter by improving the efficiency by which it splits a log. It has been found that if the splitting action itself can be improved to allow the splitting wedge to more readily and easily enter the log, a larger diameter log can be split without increase of splitting power.

Accordingly, an object of the present invention is to provide a log splitter of the ram type having increased splitting efficiency for achieving splitting of logs of larger diameter than heretofore has been possible using a given ram power.

It is also an object of the invention to provide such a log splitter which more smoothly and easily carries out the splitting action of a log by causing initial partial splitting of the face of a log prior to its being actually split by the splitting wedge.

A further object of this invention is the provision of such a log splitter which, during the splitting operation, increases splitting speed and throughput, while providing increased safety for the operator by reliably maintaining the log against the base or rail of the splitter as it is being split.

Another object of the invention is to provide such a log splitter in which the splitting wedge itself may be constructed of reduced weight and dimension, permitting reduction of the amount of expensive and heavy cutting steel heretofore needed for the splitting wedge.

Briefly, a log splitter of the invention includes a base or rail having a splitting device at one end and a ram movable along the rail for splitting logs by forcing their faces against the splitting device. The splitting device combines a splitting wedge and a penetrating device which extends forwardly from the splitting wedge for initial penetration of the face of the log, having a penetrating edge parallel to and in front of the cutting edge and located proximate the rail with height less than the cutting edge. The penetrating edge initially penetrates the log face at a location near the rail when the ram drives the log toward the splitting device. The penetrating device is itself of wedge-like, prow-configured character having diverging portions extending rearwardly from the penetrating edge on opposite sides of the cutting edge of the splitting edge of the splitting wedge to provide initial partial splitting of the log face near its periphery prior to its being driven against the cutting edge. Also, the splitting wedge is provided with a dorsal extension of reduced depth, relative to the cutting edge of the splitting wedge, to provide splitting of logs having large diameters.

Other objects and features will be in part apparent and in part pointed out hereinbelow.

BRIEF DESCRIPTION OF THE DRAWINGS

FIG. 1 is a side elevation of portions of a log splitter constructed in accordance with and embodying the present invention.

FIG. 2 is an enlarged top plan view of a splitting device of the new splitter as taken generally along line 2—2 of FIG. 1.

FIG. 3 is a rear elevation of the splitting device of FIG. 2.

FIG. 4 is a side elevation view of the splitting device itself.

FIG. 5 is a front elevation view, i.e., looking toward the splitting edge of the splitting device.

Corresponding reference characters indicate corresponding parts throughout the several views of the drawings.

DESCRIPTION OF THE PREFERRED EMBODIMENT

Referring now by reference numerals to the drawings, illustrated generally at reference numeral 10 is a log splitter of the portable type, being of the configuration including a rail 12 supported by wheels (not shown) and having a hitch 14 at one end to provide what is, in effect, a trailer for being pulled by a pick-up truck or other vehicle. Jack stand 16 at the forward end of rail 12 maintains the rail in horizontal position when disconnected from the towing vehicle.

As is conventional, rail 12 serves as a base for a log to be split when placed horizontally upon the surface of the rail at a location 18, with the log being split by the force of a ram 20 driven by a hydraulic cylinder 22 for forcing the opposite end face of the log against a splitting device designated generally 24. Conventional means, such as a gasoline engine powered hydraulic pump (not shown) provides hydraulic pressure to cylinder 22 in response to operator control.

In accordance with this invention, splitting device 24 comprises a splitting wedge 26 having a cutting edge 28, and having a widened portion rearwardly of the splitting edge which, with wedge configuration, has thickness increasing rearwardly toward the heel 30 of the wedge, which is formed of a carbon cutting steel for strength and for maintaining a sharp cutting edge. The cutting edge 28 is perpendicular to the movement of ram 20 and to the longitudinal axis of rail 12 (which may be of I-beam configuration).

Splitting device 24 includes a log penetrating device, itself of wedge-shaped character, and designated 32. Penetrating device 32 has a short penetrating edge 34 having a height much less than that of cutting edge 28, but located proximate rail 12 at the lower end of the splitting wedge. 26 for initially penetrating the log face at a location near rail 12 and near the lower edge of cutting edge 28 when the log is driven toward device 24 by ram 20. Accordingly, edge 34 will enter the face of a log near its periphery. Penetrating device 32 may be integrally forged with splitting wedge 26 or, more preferably, affixed to it by welding. Device 32 is also of wedge-like character, having diverging portions 36, 36' extending rearwardly from edge 34 on opposite sides of cutting edge 28 for providing increased thickness rearwardly of the penetrating edge 34 and also the cutting edge to cause initial partial splitting of the log face near its periphery before the major extent of the log face contacts cutting edge 28. In this way, the log is partially opened, or split, beginning at a point near its outer periphery so that a splitting bias or stress is developed by penetrating device 32, causing cracking and initial partial splitting before the cutting edge even enters the wood, and conducing to a smoother opening of the wood along the initial crack so that splitting of the remainder of the log by wedge 26 is carried out with less force. It is noted also that wedge 26 is provided with flared portions 38, 38' on opposite sides of heel 30 which cam apart the splitting halves of the log, accelerating the splitting action after it has reached this point.

The configuration of penetrating device 32 is such that it tends to force and maintain a log being split against surface 18 of rail 12. For this purpose, the penetrating device includes a tapered lower portion 34' of the penetrating edge which extends downwardly and rearwardly toward a recessed penetrating edge portion 34'' below the tapered portion 34'. Portion 34'' is parallel to and in front of cutting edge 28. The thickness of penetrating device 32 rearwardly of its lower edge portion 34' is less than its thickness, as at 36, 36', rearwardly of edge 34 and with the configuration of the penetrating device being such as to form tapered faces 40, 40' on opposite sides below portions 36, 36' to provide the penetrating device with what is essentially a boat shaped point, that is, like the prow of a boat. This configuration causes the penetrating device, as it enters the log face, to force and maintain the log against rail 12, assuring a more stable, safe splitting operation and conducing to the reliability of the entire splitting operation.

Extending upwardly from splitting wedge 26 is a dorsal vertical extension 42 which allows the splitting device 24 to split logs of diameter larger than otherwise possible. Extension 42 includes a further cutting edge 44 aligned with and extending upwardly from cutting edge 28 and thus constituting an extension of same and so also perpendicular to movement of ram 20. However, the depth, rearly from edge 44, of dorsal extension 42 is less than that of splitting wedge 26. Dorsal extension 42 is itself of wedge configuration, being defined by the upwardly extending portion 46 which defines edge 44 and a securement portion 48 of greatly reduced height which extends rearwardly across the top surface of splitting wedge 26. Portion 48 is of plate-like character for being removably secured atop the splitting wedge as by bolts 50, 52 and being otherwise of the same configuration in plan as splitting wedge 26. For logs of smaller diameter, extension 42 would not be needed.

It is found that the dorsal extension 42 does not have to be of the same depth as wedge 26, relative to the cutting edge of same, since the wedge configuration of the main wedge 26 is sufficient to cause splitting of logs even of large diameters but that the dorsal extension will allow the larger diameter log to be split because the extension opens further the crack along which splitting is occurring, but because of its reduced depth and, therefore, reduced width at its most rearward point, extension 42 does not itself force apart the halves so much as does wedge 26. In fact, it is found that the absence of material rearwardly of the dorsal extension allows the splitting stress to be more fully developed by the splitting wedge 26 in a uniform fashion and thus splitting occurs more smoothly and easily without a tendency for logs to jam or the ram to stall during splitting. From surface 18, typical dimensions are: to the top of device 32, $2\frac{3}{4}$ inches; to the top of wedge 28, 6 inches; to the top of extension 42, 11 inches.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A log splitter including a base having a log splitting device at one end and a ram movable along said base for splitting logs by forcing end faces of the log against said splitting device, characterized by said splitting device comprising a splitting wedge having a cutting edge and a widened portion rearwardly of the cutting edge, the widened portion increasing in thickness rearwardly of the cutting edge with wedge configuration, the cutting edge being perpendicular to the movement of said ram, a log penetrating device extending forwardly from said splitting wedge for initially penetrating the face of a log, the penetrating device having a penetrating edge parallel to and in front of said cutting edge, the penetrating edge having a height less than the cutting edge and being positioned relative to the rail for initially penetrating the log face at a location near said rail and proximate the lower end of the cutting edge, when the log is driven by the ram toward the splitting device, the penetrating device having diverging portions extending rearwardly from the penetrating edge and located on opposite sides of the cutting edge for providing increasing thickness rearwardly of both the penetrating edge and the cutting edge to cause initial partial splitting of the log face near its periphery prior to its being driven against the cutting edge thereby to enhance entry of said cutting edge into the log face for splitting of the log, the penetrating device including a tapered lower portion of the penetrating edge, said tapered lower portion extending downwardly and rearwardly from the penetrating edge to force and maintain a log being penetrated by the penetrating edge against said rail the penetrating device further including a recessed penetrating edge portion below said tapered portion, the recessed penetrating edge portion being parallel to and in front of said cutting edge, the penetrating device being of reduced thickness rearwardly of said lower penetrating edge portion.

2. A log splitter according to claim 1 and further characterized by the tapered penetrating edge portion defining bevelled portions on opposite sides of the penetrating device, the thickness of which tapers inwardly toward the lower penetrating edge portion.

3. A log splitter including a base having a log splitting device at one end and a ram movable along said base for splitting logs by forcing end faces of the log against said splitting device, characterized by said splitting device comprising a splitting wedge having a cutting edge and a widened portion rearwardly of the cutting edge, the widened portion increasing in thickness rearwardly of the cutting edge with wedge configuration, the cutting edge being perpendicular to the movement of said ram, a log penetrating device extending forwardly from said splitting wedge for initially penetrating the face of a log, the penetrating device having a penetrating edge parallel to and in front of said cutting edge, the penetrating edge having a height less than the cutting edge and being positioned relative to the rail for initially penetrating the log face at a location near said rail and proximate the lower end of the cutting edge, when the log is driven by the ram toward the splitting device, the penetrating device having diverging portions extending rearwardly from the penetrating edge and located on opposite sides of the cutting edge for providing increasing thickness rearwardly of both the penetrating edge and the cutting edge to cause initial partial splitting of the log face near its periphery prior to its being driven against the cutting edge thereby to enhance entry of said cutting edge into the log face for splitting of the log, the splitting wedge having a dorsal vertical extension for causing the splitting wedge to split a log of increased diameter than would be split by said splitting wedge, the dorsal extension defining a further cutting edge aligned with and extending upwardly from the first-said cutting edge in perpendicular relationship to the movement of the ram.

4. A log splitter according to claim 3 and further characterized by said dorsal extension being of less depth rearwardly from the cutting edge than said splitting wedge.

5. A log splitter according to claim 4 and further characterized by the dorsal extension being of wedge-shape character and including a first portion extending upwardly from the splitting wedge to define the dorsal cutting edge and a further portion of reduced height extending rearwardly across the top of the splitting wedge for securement thereto.

6. A log splitter according to claim 5 and further characterized by the reduced portion being of plate-like character for being removably secured to the top of said splitting wedge.

7. A log splitter including a base having a log splitting device at one end and a ram movable along said base for splitting logs by forcing end faces of the log against said splitting device, characterized by said splitting device comprising a splitting wedge having a cutting edge and a widened portion rearwardly of the cutting edge, the widened portion increasing in thickness rearwardly of the cutting edge with wedge configuration, the cutting edge being perpendicular to the movement of said ram, a log penetrating device extending forwardly from said splitting wedge for initially penetrating the face of a log, the penetrating device having a penetrating edge parallel to and in front of said cutting edge, the penetrating edge having a height less than the cutting edge and being positioned relative the rail for initially penetrating the log face at a location near said rail and proximate the lower end of the cutting edge, when the log is driven by the ram toward the splitting device the penetrating device having diverging portions extending rearwardly from the penetrating edge and located on opposite sides of the cutting edge for providing increasing thickness rearwardly of both the penetrating edge and the cutting edge to cause initial partial splitting of the log face near its periphery prior to its being driven against the cutting edge thereby to enhance entry of said cutting edge into the log face for splitting of the log said penetrating device being prow-shaped for forcing the log downwardly and rearwardly as the log is penetrated by said penetrating device to force and maintain the log against said rail, said splitting wedge including a vertical extension for increasing the effective height of said wedge, said extension being of less depth rearwardly from said cutting edge than said wedge.

* * * * *